US005887316A

United States Patent [19]

Ferrari et al.

[11] Patent Number: 5,887,316

[45] Date of Patent: Mar. 30, 1999

[54] ONE-PIN FURNITURE HINGE WITH ADJUSTING SYSTEM

[75] Inventors: Franco Ferrari, Località Deviscio, 2, 22053 Lecco; Carlo Migli, Lecco, both of Italy

[73] Assignee: Franco Ferrari, Italy

[21] Appl. No.: 855,649

[22] Filed: May 3, 1997

[30] Foreign Application Priority Data

May 15, 1996 [IT] Italy ..... MI960359 U

[51] Int. Cl.[6] ..... E05D 7/04

[52] U.S. Cl. ..... 16/245; 16/238

[58] Field of Search ..... 16/246, 245, 235, 16/238

[56] References Cited

U.S. PATENT DOCUMENTS 3,909,879 10/1975 Grunert et al. ..... 16/245
4,293,976 10/1981 Pittasch et al. ..... 16/245
4,493,129 1/1985 Grass ..... 16/246
4,604,769 8/1986 Rock et al. ..... 16/245

*Primary Examiner*—Chuck Y. Mah
*Assistant Examiner*—Donald M. Gurley
*Attorney, Agent, or Firm*—Shlesinger, Fitzsimmons & Shlesinger

[57] ABSTRACT

A single-pin furniture hinge of the box type comprises a first (11) and a second (12) fastening element designed to be fastened to two furniture parts to be hinged together and an arm (15) provided at one end with the first fastening element (11) and at the other end with hinging elements (16) for hinging it to the second fastening element (12) to achieve the articulation of the hinge. The arm (15) is composed of a first (19) and a second (20) part which reciprocally slide upon operation of adjusting screw (31) to enable adjustment of the reciprocal position of the two fastening elements (11, 12). The adjusting screw (31) having its axis coinciding with the direction of adjustment of the hinge and cooperating with said first (19) and second (20) part to achieve their reciprocal sliding upon rotation of the screw.

6 Claims, 1 Drawing Sheet

ONE-PIN FURNITURE HINGE WITH ADJUSTING SYSTEM

BACKGROUND OF THE INVENTION

This invention refers to a furniture hinge of the box type with a single journal, provided with a device for the lateral adjustment of the door with respect to the side panel of the furniture unit.

Single-pin hinges, of the type known as "frame hinges", are widely used. In their simplest and most inexpensive form of embodiment, they consist of four main components: a fixed part or wing (designed to be integrally secured to the side panel of the furniture unit), a movable part or box (designed to be integrally secured to the door), a journal and a spring to ensure their automatic closure. These simple hinges do not allow for any reciprocal adjustment between the fixed part and the movable part. To be able to achieve adjustment of the coverage of the side panel by the door, single-pin hinges have been produced in which the wing is made in two pieces, one of which bears the means for fastening it to the side panel and the other bears the means for hinging it to the box. The two pieces are connected together by means of a screw screwed into one of them and fitting with its shank, perpendicular to the adjusting direction, into a slot provided in the other piece. By loosening the fastening screw, the two pieces can slide reciprocally, thereby permitting adjustment. The pieces are subsequently locked into the desired position by tightening the screw.

An adjustment of ths kind, however, is difficult and inaccurate, due to the fact that when the screw is loosened the two parts are free to slide along the entire adjusting stroke permitted by the length of the slot. The difficulties are amplified by the fact that the hinge is obliged to bear the weight of the door, which tends to make the two parts slide inconveniently as soon as the fastening screw is loosened. The desired amount of coverage of the side panel can thus only be found by trial and error.

Moreover, when the hinge is closed, the head of the screw protrudes inside the box in a central position, creating a hindrance which could prove critical in housing the closing mechanism of the hinge. It is obvious that, unlike the conventional hinges, in the "frame"-type hinges, in which the free space between the closing mechanism and the walls of the box is extremely limited, it is essential to have a lateral adjustment device which is of limited overall dimensions and is easily accessible.

The general scope of this invention is to obviate the aforementioned problems by providing a single-pin hinge of the box type with extremely precise and easy to use lateral adjustment, in which the adjusting device is of very limited overall dimensions.

SUMMARY OF THE INVENTION

This scope is achieved according to the invention by providing a single-pin furniture hinge of the box type, comprising a first and a second fastening element designed to be fastened to two furniture parts to be hinged together and an arm provided at one end with the first fastening element and at the other end with hinging means for hinging it to the second fastening element to achieve the articulation of the hinge, the arm being composed of a first and a second part which reciprocally slide upon operation of adjusting means to enable adjustment of the reciprocal position of the two fastening elements, characterized by the fact that the adjusting means comprise a screw having its axis coinciding with the direction of adjustment of the hinge and cooperating with said first and second part to achieve their reciprocal sliding upon rotation of the screw.

BRIEF DESCRIPTION OF THE DRAWINGS

The innovative principles of this invention and its advantages with respect to the known technique will be more clearly evident from the following description of a possible exemplificative embodiment applying such principles, with reference to the accompanying drawings, in which.

DETAILED DESCRIPTION OF THE INVENTION

Figures 1, 2, 3:
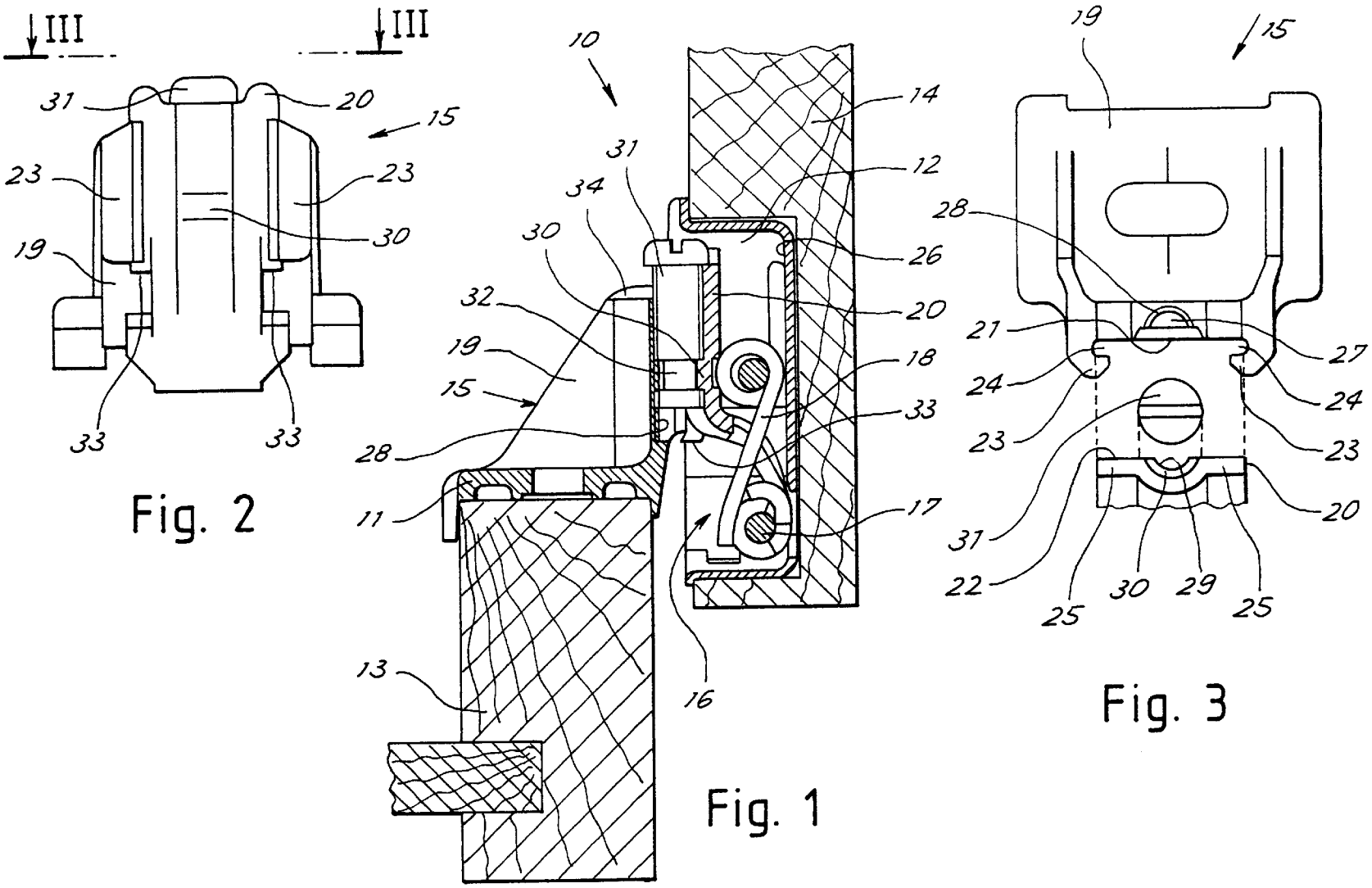
FIG. 1 shows a partial cutaway side view of a hinge according to the invention, shown in the closed position.
FIG. 2 shows a front view of the hinge arm of FIG. 1.
FIG. 3 shows an exploded view of the components of the hinge arm, viewed along the line III—III of FIG. 2, illustrating the first and second parts (19, 20) of the arm being shown in spaced, unassembled, confronting relation with the screw (31) disposed in the space therebetween.

With reference to the figures, a single-pin hinge 10, of the type known as a "frame hinge", comprises a first and a second fastening element 11, 12, designed to be secured respectively to two furniture parts to be hinged together, for example a side panel 13 and a door 14.

As can be clearly seen in FIG. 1, the hinge comprises an arm 15, being provided at one end with the first fastening element 11 and at the other end with hinging means 16 for hinging it to the second fastening element or box 12 to achieve the articulation of the hinge. The configuration of the hinging means around the axis of rotation 17, which is clearly visible in FIG. 1, is of known technique and therefore is not described here in detail in that it may vary in relation to particular structural requirements. For example, it may be advantageous to provide a spring 18, reacting between the box and the hinging, to define stable open and closed positions of the hinge.

The arm 15 is composed of a first and a second part 19, 20 which slide reciprocally to enable the adjustment of the reciprocal position of the two fastening elements 11, 12. In particular, the first part 19 comprises the first fastening element 11, while the second part 20 comprises the hinging means for hinging it to the box 12.

The two parts 19, 20 have reciprocally sliding surfaces 21, 22 disposed one on top of the other. Advantageously, the first part 19 comprises lateral edges 23 disposed facing each other on opposing sides of the sliding surface 21. The edges 23 are shaped to form guide channels 24 which slidingly receive sliding wings 25 of the second part 20. The guides 24 extend parallel to the front surface of the side panel 13 of the furniture unit, perpendicular to the axis of rotation of the hinge, to permit the reciprocal sliding of the two parts 19, 20 only in the direction of adjustment of the door 14 with respect to the side panel 13.

As can be seen in FIG. 1, when the hinge is in the closed position the second part 20 of the arm 15 is contained inside the box 12, facing the bottom 26 of the box and spaced slightly apart from it.

According to the invention, disposed on the coupling surface 21 of the first part 19 of the hinge arm, as can be seen in FIG. 3, is a first slot 27 elongated in the reciprocal sliding direction of the two parts 19, 20. The slot 27 has a circular cross-section, advantageously with an arc equivalent to or slightly smaller than 180°, and a threaded internal surface 28.

Disposed on the second coupling surface 22 of the second part 20 of the hinge arm is a second elongated slot 29 disposed in a position corresponding to the first slot 27 when the two parts 19, 20 are coupled together. The second slot 29, which also has a circular cross-section, presents an axial portion 30 with a limited radial dimension. The facing slots 27, 29 constitute a housing to receive a screw having a radius substantially equivalent to the radius of the slots.

The shank of the screw 31, as can be seen in FIG. 1, is provided with a portion 32 having a limited radius, whose radial and axial dimensions correspond to those of the portion 30 of the slot 29 to constitute an axial constraint for the screw in the slot.

A brief description will be given of the assembly of the hinge and its adjustment. The screw 31 is placed inside the slot 29, free to rotate but not to slide axially with respect to the second part 20 of the hinge arm because it is restricted by the coupling between the respective portions 30, 32. The two components thus assembled are then coupled to the first part 19 of the hinge arm by fitting the wings 25 of the element 20 into the runners 24 of the element 19 until the screw 31 begins to engage the thread of the first slot 27. At this point, the element 20 is shifted to the desired position and the screw 31 is screwed into the housing.

At this point it is clear how the intended scope of obtaining a "frame" type hinge with a lateral adjusting device characterized by high precision and operating simplicity and limited overall dimensions has been achieved. In fact, in FIG. 1 it can be seen that when the hinge is in the closed position no further obstruction caused by the screw is present in the box.

The foregoing description of an embodiment applying the innovative principles of this invention is obviously given by way of example in order to illustrate such innovative principles and should not therefore be understood as a limitation to the sphere of the invention claimed herein. For example, the dimensions of the reciprocally movable parts 19, 20 can be chosen on the basis of specific functional requirements, In particular, the element 20 can be made of such size that, even in the position of maximum extension of the hinge, the sliding wings 25 protrude, with their portions of end 33 at a distance from the adjusting screw, beyond the end of the runners 24. Thus, upon completion of the assembling, the aforesaid end portions can be riveted so as to prevent the hinge from being adjusted beyond the maximum estimated limit or from being accidentally disassembled. The adjusting stroke is consequently limited on one side by interference of the riveted portions 33 with the runners and on the other side by the head of the screw 31 striking against the corresponding end 34 of the element 19.

What is claimed is:

1. Single-pin furniture hinge, comprising a first and a second fastening element designed to be fastened to two furniture parts to be hinged together, and an arm provided at one end with the first fastening element and at the other end thereof with hinging means for hinging said arm to the second fastening element to achieve the articulation of the hinge, the arm being composed of a first and a second part which reciprocally slide relative to each other upon operation of adjusting means to enable adjustment of the reciprocal position of the two fastening elements, characterized by the fact that the first and second parts respectively have thereon reciprocal coupling and sliding surfaces, that the adjusting means comprises a screw having its axis coinciding with the direction of adjustment of the hinge and cooperating with said first and second parts to achieve their reciprocal sliding upon rotation of the screw, that disposed on the coupling surface of the first part is a first slot that is semi-cylindrical in transverse cross section and elongated in the reciprocal sliding direction of the two parts, and that disposed on the coupling surface of the second part, and in confronting relation to the first slot when the two parts are coupled together, is a second elongated slot similar in cross sectional configuration to the first slot, the surface of the first slot having formed thereon threads complimentary to those of the screw, and the two slots disposed in facing relation to each other constituting an axial housing for the screw.

2. Hinge as claimed in claim 1, characterized by the fact that the threads of the first slot form a threaded internal surface to engage with the thread on the screw and that the second slot has means for preventing the screw from sliding axially within it.

3. Hinge as claimed in claim 2, characterized by the fact that the means for preventing the axial sliding of the screw consist of an axial portion of the second slot having a reduced radial dimension complementary to a corresponding portion with a reduced radius of the shank of the screw.

4. Hinge as claimed in claim 1, characterized by the fact that the first part comprises lateral edges disposed facing each other on opposing sides of the sliding surface of the first part to form guides which slidingly receive the second part.

5. Hinge as claimed in claim 1, characterized by the fact that the first part comprises the first fastening element, while the second part comprises the hinging means for hinging the second part to the second fastening element.

6. Hinge as claimed in claim 1, characterized by the fact that a reaction spring is disposed between the hinging means and the second fastening element to define stable open and closed positions of the hinge.

* * * * *